United States Patent [19]

Shiguma et al.

[11] 3,959,931

[45] June 1, 1976

[54] GRINDING MACHINE FOR COIL SPRINGS

[75] Inventors: Heijiro Shiguma; Shigekazu Suzuki, both of Yokohama, Japan

[73] Assignee: NHK Spring Co., Ltd., Yokohama, Japan

[22] Filed: Oct. 21, 1974

[21] Appl. No.: 516,413

[30] Foreign Application Priority Data

Oct. 25, 1973 Japan ..... 48-120146

[52] U.S. Cl. ..... 51/112; 51/118

[51] Int. Cl.[2] ..... B24B 7/06; B24B 7/16

[58] Field of Search ..... 51/110, 116, 117, 118, 51/215 E, 215 M; 29/173

[56] References Cited

UNITED STATES PATENTS

| | | | |
|---|---|---|---|
| 766,403 | 8/1904 | Vincke | 51/118 |
| 836,684 | 11/1906 | Hird | 51/215 E |
| 1,926,974 | 9/1933 | Einstein | 51/118 X |
| 2,732,590 | 1/1956 | Le Clercq | 51/110 X |
| 2,767,623 | 10/1956 | Hanson | 51/118 |

FOREIGN PATENTS OR APPLICATIONS

| | | | |
|---|---|---|---|
| 253,883 | 11/1912 | Germany | 51/118 |
| 740,421 | 11/1955 | United Kingdom | 51/118 |

*Primary Examiner*—Al Lawrence Smith
*Assistant Examiner*—Nicholas P. Godici
*Attorney, Agent, or Firm*—Flynn & Frishauf

[57] ABSTRACT

A large number of unit carriers are fed by an endless chain into a horizontal passageway within the grinding machine in a state each having a coil spring as a workpiece received thereon. Before reaching the position of a grinding wheel disposed at one side of the passageway, the coil spring on each carrier is clamped thereto by a clamping lever provided thereon. For the purpose of swinging the clamping lever up to a clamping position, an urging bar to be engaged therewith is disposed along the passageway above the same in a state carried into the movement locus of the clamping lever.

42 Claims, 4 Drawing Figures

GRINDING MACHINE FOR COIL SPRINGS

BACKGROUND OF THE INVENTION

This invention relates to a grinding machine for grinding the end faces of a coil spring as a workpiece.

The conventional grinding machine of this type includes, for example, one having a construction wherein the lower end portion of each of plural coil springs is inserted into each of those plural holes for holding the coil springs in place which are formed in the base plate; and in a state wherein each coil spring is vertically held in place a grinding wheel is pressed against the upper end face of each coil spring, thereby to perform grinding. In this type of grinding machine, the number of coil springs ground per unit time depends upon the grinding area of the grinding wheel, namely, upon the wheel diameter, failing to grind so large a number of coil springs. If the grinding ability is forcibly improved, the wheel diameter will be enlarged to an extreme extent, which renders the machine bulky and simultaneously increases the possibility of wheel breakage occurring during the wheel rotation. Further, since, in this type of grinding machine, the diameter of the spring retaining hole is so specified as to conform with a specific spring diameter, there is the inconvenience that it is impossible to grind coil springs whose diameters are different from the specific spring diameter.

The conventional grinding machine also includes one constructed such that coil spring retaining jigs, respectively, specified for each diameter of various coil springs are respectively set on the base plate of the machine, thereby to retain each coil spring on the base plate via each jig. However, in this construction, the jig replacement should be performed each time the spring diameter is varied, which makes the replacement operation troublesome, failing to attain high operational efficiency.

SUMMARY OF THE INVENTION

An object of the invention is to provide a grinding machine capable of quickly and reliably grinding coil springs as workpieces.

Another object of the invention is to provide a grinding machine capable of freely grinding coil springs having different diameters without being followed by a particular troublesome operation.

The grinding machine according to the invention is constructed such that a horizontal passageway is provided within the machine frame; and coil springs as workpieces are conveyed through the passageway in a state each supported by carrier means continuously conveyed by conveying means such as an endless chain. The carrier means in large number are provided in series at prescribed intervals and are respectively conveyed by common conveying means. Clamping means for holding in place coil springs on the carrier means are provided on the carrier means, and by said clamping means coil springs different in diameter are reliably held in place. The clamping function of the clamping means is rendered effective by urging means while the grinding operation by a grinding element provided at least at one side of a passageway such as a grinding wheel is performed during a period in which coil spring are conveyed through the passageway.

The grinding machine of the invention has the merits that since coil springs are continuously conveyed by a large number of carrier means and ground, the grinding efficiency per unit time is elevated; since coil springs of given diameters can be clamped on the carrier means by clamping means, the attachment operation for attaching coil springs within the machine is not troublesome; the machine itself is adapted for automatization of the respective operational steps for grinding coil springs such as the attachment step for attaching coil springs within the machine, the conveyance step for conveying coil springs to the position at which grinding is carried out, the grinding step, the feeding-out step for finished coil springs, and so on.

DESCRIPTION OF THE PREFERRED EMBODIMENTS

Figure 1:
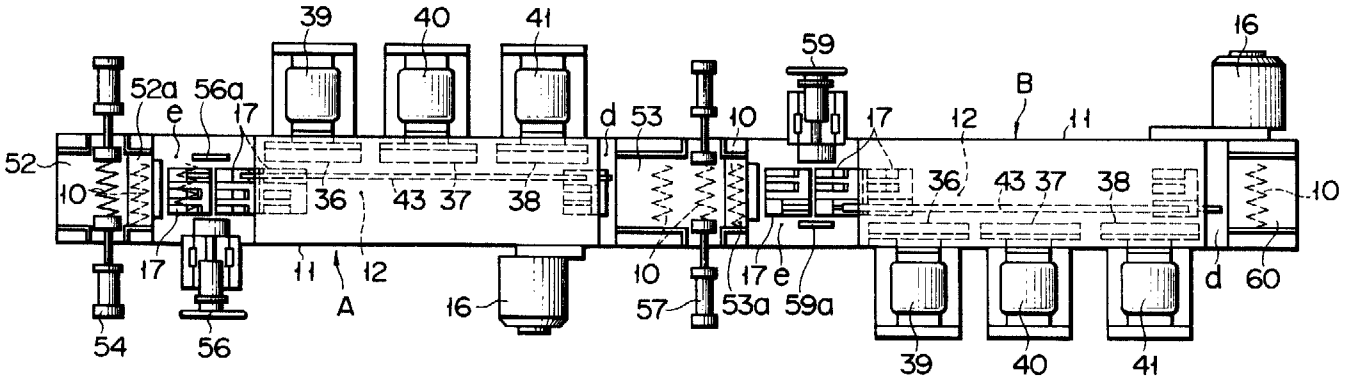
FIG. 1 is a top view of a grinding machine system connecting together two grinding machines according to the invention.
Figure 2:
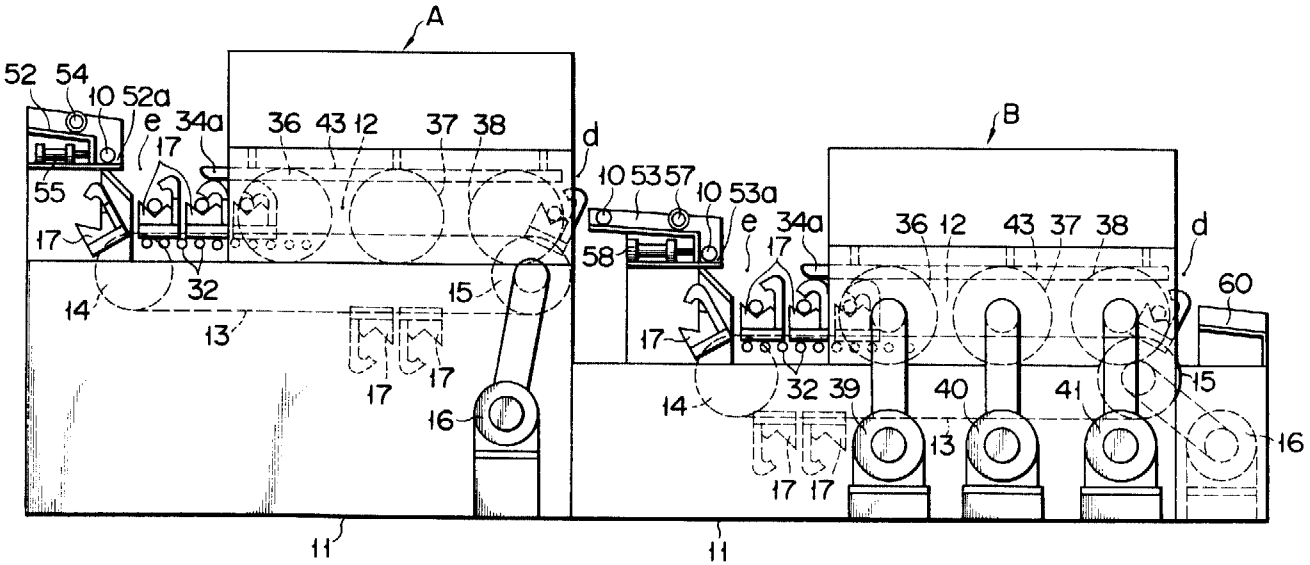
FIG. 2 is a side view of FIG. 1.

Referring to FIGS. 1 and 2, two grinding machines A and B according to the invention are connected together so as to constitute a grinding machine system. The system is arranged so that one end face of a coil spring 10 as a workpiece is ground by one grinding machine A while the other end face is ground by the other grinding machine B. The machines A and B have the same construction except that some parts or sections are arranged in a manner different from one another. Accordingly, with the same parts and sections denoted by the same reference numerals the machine A in principle will hereinafter be described in detail.

A substantially horizontal passageway 12 is provided through the machine frame 11 of the grinding machine A. The forward end of the passageway 12 is taken as the feed-in end position *e* at which the coil spring 10 is fed into the machine A while the rearward end of the passageway 12 as the feed-out end position *d* at which the coil spring 10 after completion of its grinding is fed out from the machine A rearwardly thereof.

An endless chain 13 as conveying means is arranged below the passageway 12 along the same and is guided by two guide pulleys 14 and 15 so as to travel continuously. One guide pulley 15 is connected to a chain driving motor 16. The guide pulleys 14 and 15 and the motor 16 are all supported by the machine frame 11.

Figure 3:
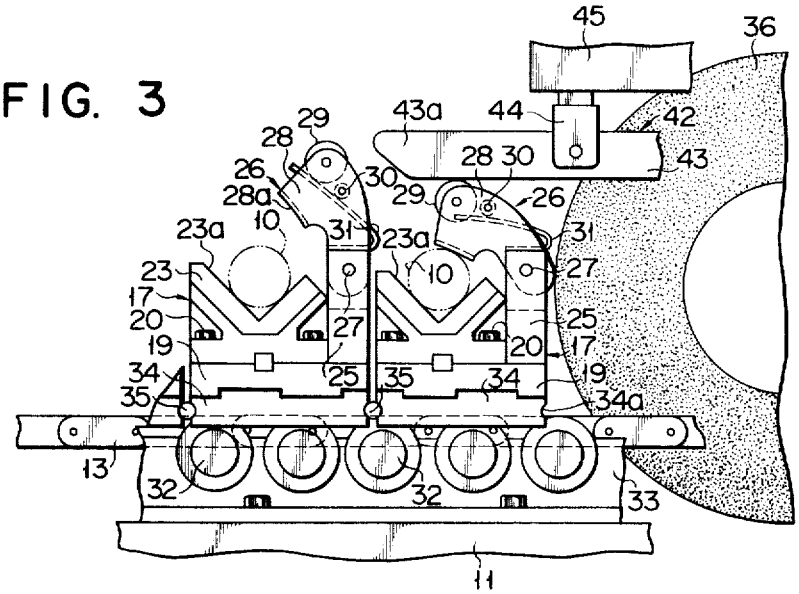
FIG. 3 is a partially enlarged view of FIG. 2, illustrating the carrier means and the sections associated therewith of the grinding machine system illustrated in FIG. 2.
Figure 4:
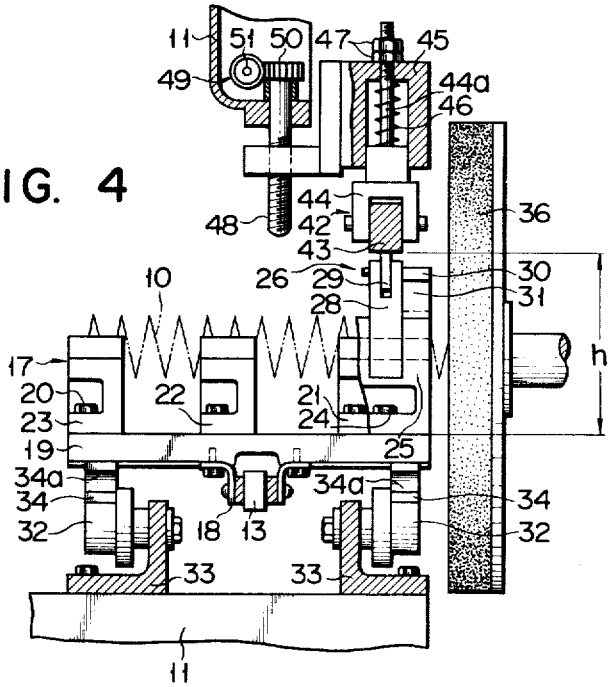
FIG. 4 is an illustration as viewed from the right side of FIG. 3.

As illustrated enlarged and in detail in FIG. 3, a large number of carrier means 17 for receiving coil springs 10 thereon are attached onto the endless chain 13. The respective carrier means 17 include a base plate 19 whose underside is secured to the chain 13 via a connection member 18 as shown in FIG. 4, three receptacle members 21, 22 and 23 secured by bolts 20 to the upper surface of the base plate 19, and a post member 25 secured by bolts 24 to the base plate 19 at the back of the receptacle members so as to be erected perpendicularly with respect to the base plate. The relative positions of the base plate 19 to the receptacle members 21, 22 and 23 are prevented by the key-to-key groove engagement from being displaced. The three receptacle members 21 to 23 are arranged at prescribed intervals crosswise to the passageway 12, the main receptacle member 21 being disposed along one side edge of the base plate 19, the auxiliary receptacle member 23 along the other side edge of the base plate, the remaining auxiliary receptacle member 22 substantially at the middle position of the base plate. As seen from FIG. 4, the main receptacle member 21 is formed transversely wider than the two auxiliary receptacle members 22 and 23. The upper surfaces of the receptacle members 21 and 23 are formed with respective V-shaped receiving surfaces 21*a*, 22*a* and 23*a*, in which the coil spring 10 to be ground is received. Accordingly, the coil spring 10 is arranged in a direction crosswise to the passageway 12. The receiving surfaces 21*a* to 23*a* may be of any configuration including U-shape if formed at least concave. Further, the three receptacle members 21 to 23 can be replaced by a single, transversely elongate member. The receptacle members 21 and 23 may be provided in larger number than 3, and the number thereof is properly determined depending upon the length of the coil spring as a workpiece.

The post member 25 is positioned immediately rearward of the main receptacle member 21 and is provided at the upper end portion with clamping means 26, which includes a swingable lever 28 pivotally mounted by a pivot 27 upon the post member 25, an engagement roll 29 rotatably mounted on the lever 28, and a leaf spring 31 for biasing the lever 28 via a pin 30 in the clockwise direction of FIG. 3. When the leaf spring 31 is kept in an original or natural condition, the swingable lever 28 is kept at a position clockwise swung to a maximum extent (i.e., the position at which the coil spring is released). FIG. 3 illustrates the condition wherein the lever 28 on the carrier means 17 is brought to the coil spring releasing position. The lever 28 is formed with an arcuate surface 28*a*.

A combined unit of carrier means 17 and clamping means 26 has the same construction as another, and these combined units are consecutively aligned in a line in a manner slightly spaced from each other along the endless chain 13, and arrangement is so made that the carrier means 17 are conveyed through the passageway 12 by the endless chain 13 from the coil spring feed-in end position *e* to the coil spring feed-out end position *d* and thereafter are returned from the position d to the position e along the underside of the endless chain 13. In this way, the carrier means 17 are circulated while the chain 13 is being driven. In FIGS. 1 and 2, some of the carrier means 17 as mounted are partially illustrated.

Within the machine frame 11 a large number of guide rolls 32 are arranged in two parallel lines along the passageway 12 in a manner each rotatably supported by a pair of support brackets 33 secured to the machine frame 11. As shown in FIG. 4, guide rail members 34 are fixed to both side edge portions of the underside of the base plate 19 for the carrier means 17 in a downwardly extending manner. The respective guide rail members 34 slidably engage a series of guide rolls 32. The constructive relationship between the guide rolls 32 and the guide rail members 34 enables the carrier means 17 to travel through the passageway 12 without vertical vibration.

The forward and rearward end faces of each guide rail member 34 are formed with respective arcuate recesses 34*a*. A fulcrum pin 35 is crosswise disposed between the guide rail members 34 for the two adjacent carrier means 17 so as to engage the mutually opposite arcuate recesses 34*a* of the two adjacent guide rail members 34. By said fulcrum pin 35, the space between the two adjacent carrier means 17 is limited, and simultaneously the carrier means 17 are prevented from being individually vertically vibrated during conveyance. The fulcrum pin 35, when the endless chain 13 passes through the feed-out end position *d* to move downwardly, permits the carrier means 17 to be relatively swung about the fulcrum pin 35.

Three grinding wheels 36, 37 and 38 as constituting the grinding element, for grinding the end face of the coil spring 10 are juxtaposed at one side of the passageway 12 of the grinding machine A at prescribed intervals. To the grinding wheels 36 to 38 are connected drive motors 39, 40 and 41, respectively. The grinding wheel 36 disposed at the foremost position of the passageway 12 is principally used for rough-grinding the end face of the coil spring 10, the grinding wheel 38 for finish-grinding said end face, and the intermediate wheel 37 for a middle extent of grinding.

An urging bar 43 constituting part of urging means 42 is arranged above the passageway 12 along the same substantially in parallel therewith. The forward end 43*a* of the urging bar 43 is extended up to the proximity of the coil spring feed-in end position *e* and the rearward end thereof up to the coil spring feed-out end position *d*. The urging bar 43 is connected by pins to forked supporting members 44 at its several lengthwise positions. As seen from FIG. 4, threaded rod portions 44*a* are provided on the upper ends of the respective supporting members 44, and are vertically movably inserted into respective intermediate member 45. Between the intermediate member and the supporting member 44 is disposed a compression coil spring 46 in a state wound about the rod portion 44*a*. Over the upper end portion of the rod portion 44*a* are fitted two adjustment nuts 47 by screw engagement. Into the intermediate member 45 is fitted by screw engagement a screw rod 48 as vertically arranged. The screw rod 48 is connected to a driving mechanism 49 mounted within the machine frame 11. The driving mechanism 49 includes a worm wheel 50 secured to the upper end of the screw rod 48, a worm 51 intermeshed with the worm wheel 50 and a drive motor (not shown) for rotating the worm 51. When the drive motor is driven by the operator's switching operation, the screw rod 48 is rotated via the worm 51 and the worm wheel 50 thereby to vertically vary the position of the intermediate member 45. This variation equivalently corresponds to the vertical variation in the position of the urging bar 43. Further, by varying the relative position of the rod portion 44*a* to the adjustment nut 47 through adjusting the nut the relative position of the supporting member 44 to the intermediate member 45 is varied, and the biasing force of the compression coil spring 46 is varied accordingly. The variation in the relative position of the supporting member 44 equivalently corresponds to the vertical variation in the position of the urging bar. This vertical variation is smaller than that due to the driving mechanism 49. For this reason, vertical adjustment of the position of the urging bar 43 is carried out using the driving mechanism 49 while adjustment of the biasing force of the spring 46 is performed using the adjustment nut 47.

The urging bar 43 is carried into the movement locus pictured when the clamping means 26 is moved jointly with the carrier means 17 through the passageway 12. For this reason, when the clamping means 26 is moved from the coil spring feed-in end position *e*, the urging bar 43 engages the engagement roll 29 of the clamping means thereby to swing the swingable lever 28 about the pivot 27 against the biasing force of the leaf spring 31 in a counter-clockwise direction from the coil spring releasing position. As a result of the lever swing, the arcuate surface 28*a* of the lever 28 is pressed against the coil spring 10 received in the main receptacle member 21, thereby to clamp the coil spring 10 in the main receptacle member 21 so as to make it motionless. The angle through which the swingable lever 28 is swung up to the clamping position varies with the coil spring diameter. Accordingly, if, in case the coil spring 10 is varied in diameter, the vertical position of the urging bar 43 is adjusted, by operating the driving mechanism 49 by an amount corresponding to the diameter variation, an always precise coil spring clamping wil be possible. Further, by adjusting the biasing force of the compression coil spring 46 through the adjustment nut 47 the clamping pressure will be able to be a proper value. Further, the presence of the compression spring 46 makes it possible that even when there exist errors in the coil spring diameter or in other associated parts, the coil spring 10 is pressed always under a constant pressure by the urging bar 43. Accordingly, the coil spring 10 is prevented from being excessively pressed by the urging bar 43.

The coil spring clamping by the urging bar 43 has only to be performed at least when the coil spring has been brought to a position being ground by the grinding wheels 36 to 38. Accordingly, the urging bar 43 may not be single as in the embodiment, but construction can also be so made that a plurality of urging bars are individually disposed in corresponding relation to the positions of the grinding wheels 36 to 38.

On the grinding machine A having the foregoing construction are additionally provided as attachments such devices as are hereinafter described. Disposed ahead of the coil spring feed-in end position *e* is a chute 52 for facilitating introduction of the coil spring as a workpiece into the receptacle members 21 to 23 of the carrier means. A similar chute 53 is also disposed immediately back of the coil spring feed-out end position *d* of the grinding machine A.

On the chute 52 is disposed a pusher 54, which so functions as to sandwich both ends of the coil spring as a workpiece introduced from outside onto the chute 52 thereby once holding it in place and sequentially send it into the receiving section 52*a* of the chute to the accompaniment of the coil spring grinding speed. The coil spring 10 sent into the receiving section 52*a* of the chute is introduced or dropped by another pusher 55 from the receiving section 52a of the chute into the receptacle members 21 to 23 of the carrier means. The transverse position of the coil spring 10 received in the receptacle members 21 to 23 is determined by a work setting device 56 disposed immediately back of the coil spring feed-in end position *e*. The work setting device 56 includes a stopper 56*a*, and one end face of the coil spring which is to be ground is pressed against the stopper 56*a* by operation of the device 56, so that a transverse grinding position for the coil spring is precisely determined.

Devices 57, 58 and 59 similar to the above-mentioned pushers 54 and 55 and work setting device 56, respectively are disposed on a back chute 53 and other associated sections, respectively. These devices 57 to 59 and back chute 53 can be regarded as attachments for another grinding machine B. The back chute 53 includes a receiving section 53*a*, and the work setting device 59 includes a stopper 59*a* for transversely positioning the other end face of the coil spring 10.

While the machine A is adapted to grind one end face of the coil spring 10, the machine B is adapted to grind the other end face. In the machine B, therefore, grinding wheels and a drive motor for driving the same are disposed at the passageway side opposite to that on which the wheels and motor of the machine A are disposed. Further, the respective dispositions in the machine A of the three receptacle members 21 to 23 and the urging bar 43 and the respective dispositions in the machine B of the members and bar are rendered symmetrical about the passageway 12.

Another chute 60 is disposed back of the spring feed-out end portion *d* of the machine B. The coil spring 10 whose both end faces are subject to finish-grinding through the machines A and B is fed out from the chute 60 into the exterior.

There will now be described the operation of grinding both end faces of the coil spring 10 by the machines A and B.

When given carrier means 17 is situated at the coil spring feed-in end position *e*, the clamping means is kept at the coil spring releasing position due to no engagement with the urging bar 43, so that a space above the receptacle members 21 to 23 remains open (which indicates the condition wherein the swingable lever 28 does not cover the receptacle members 21 to 23). A coil spring 10 as the workpiece is dropped by the pusher 55 from the receiving section 52*a* of the chute into the receptacle members 21 to 23 kept at said conditions. As the carrier means 17 is sequentially conveyed by the endless chain 13 into the passageway 12, the coil springs 10 are dropped one by one onto the carrier means 17 sequentially arriving at the coil spring feed-in end position *e*. The coil spring 10 received in the carrier means 17 is subjected to transverse positioning by the work setting device 56, and thereafter is clamped onto the receptacle members 21 to 23 when the swingable lever 28 is swung to the clamping position due to the engagement between the engagement roll 29 and the urging bar 43, and thereafter is fed to the position of the first grinding wheel 36. One end face of the thus fed coil spring 10 is subjected to rough-grinding by said grinding wheel 36. In this manner, the coil spring 10 conveyed through the passageway by the carrier means 17 is further subjected to middle-grinding and finish-grinding by the second and third grinding wheels 37 and 38, and then is fed out to the coil spring feed-out end position *d*. At this time, the engagement roll 29 is disengaged from the rearward section of the urging bar 43 to permit the swingable lever 28 to be swung by the spring 31 to the coil spring releasing position, that is, go away from the finished coil spring 10. And when the carrier means 17 is lowered jointly with the endless chain 13 from the coil spring feed-out end position *d*, the coil spring 10 alone is allowed to pop out onto the back chute 53 and checked by the rearwardly positioned pusher 57. This coil spring 10 is fed to the machine B in the same manner as in the machine A, and whithin the machine B the other end face of the coil spring 10 is ground.

Since the passageway 12 of the machine B is kept in a state a little more lowered than the passageway of the machine A and the back chute 53 connecting together both passageways is inclined, the coil spring 10 is easily transferred from the machine A to the machine B.

By adopting the construction wherein the coil springs as workpieces are mounted one by one upon each of many carrier means 17 continuously conveyed in turn, the number of coil springs ground per unit time has been largely increased. Further, since each coil spring is reliably clamped onto the receptacle members 21 to 23, the coil spring grinding can with high precision be carried out.

Although, in the preceding embodiment, the three grinding wheels 36 to 38 were provided for the machines A and B, respectively, they can optionally be employed depending upon the material quality of the coil spring as a workpiece or upon the desired degree of finish-grinding, for example, in a manner that only the first and third ones of said three wheels are employed with the second wheel rotation stopped.

Further, where it is desired to grind the coil springs 10 having a different diameter, the height of the urging bar 43 has only to be adjusted by operating the driving mechanism 49. The height *h* of the urging bar 43 is measured by taking the base plate 19 as a reference, for example, as shown in FIG. 4. For this purpose, the machine frame 11 is provided with a scale for measuring said height *h*, though not shown.

What we claim is:

1. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame, each of said carrier means including a base plate and receptacle means mounted on said base plate, said receptacle means having concave surfaces for engagement with a coil spring;

conveying means for consecutively conveying said carrier means at prescribed intervals through said passageway from a coil spring feed-in end position at one end of said passageway to a coil spring feed-out end position at the other end of said passageway, said conveying means including an endless chain, said base plates being secured in series to said endless chain;

clamping means provided on each of said carrier means and swingable between a clamping position for clamping the coil spring received by said each carrier means by engagement therewith, and a coil spring releasing original position in which the clamping means is disengaged from the coil spring;

grinding means disposed at the side of said passageway for grinding the end face of the coil spring fed by said carrier means through said passageway; and urging means for urging said clamping means to said clamping position, the urging action of said urging means being rendered effective at least during a period of time in which the end face of the coil spring is ground by said grinding means.

2. A grinding machine according to claim 1, wherein said grinding means includes a grinding wheel.

3. A grinding machine according to claim 1, wherein said grinding means includes a plurality of grinding wheels disposed along said passageway at prescribed intervals.

4. A grinding machine according to claim 1, wherein said urging means includes an urging bar arranged above said passageway and substantially in parallel therewith, one end of said urging bar extending up to the proximity of said coil spring feed-in end position.

5. A grinding machine according to claim 1, wherein said urging means comprises urging force adjusting means for adjusting the urging force of said urging means.

6. A grinding machine according to claim 1, further comprising height adjusting means for adjusting the height of said urging means relative to said clamping means.

7. A grinding machine according to claim 1, wherein each of said carrier means further comprises a pair of guide rail members mounted to both edge portions of the underside of each base plate; and said machine frame comprises a plurality of guide rolls rotatably mounted thereon for slidably supporting said guide rail members, said guide rolls being arranged in two parallel lines along said passageway.

8. A grinding machine according to claim 7, wherein each of said guide rail members has forward and rearward end faces each of which is formed with an arcuate recess, and wherein said grinding machine further comprises a fulcrum pin engaged with the mutually opposite arcuate recesses of two adjacent guide rail members, said fulcrum pin limiting an interval between two adjacent carrier means and to prevent relative vertical movement between said two adjacent carrier means.

9. A grinding machine according to claim 4, wherein said clamping means includes a swingable lever pivotally mounted on each carrier means and an engagement roll rotatably pivoted by said swingable lever and engageable with said urging bar, said clamping means being maintained at said clamping position while said engagement roll is an engagement with said urging bar.

10. A grinding machine according to claim 1, wherein said urging means includes an urging bar arranged along said passageway above the same and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for the purpose of adjusting the vertical position of said intermediate member by its rotation.

11. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame, each of said carrier means including a base plate, and at least three receptacle members mounted on said base plate and disposed crosswise with respect to said longitudinal direction of said passageway at prescribed intervals therebetween, each of said receptacle members having concave surfaces adapted to be engaged with a coil spring, one of said receptacle members being formed transversely wider than the others of said receptacle members;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring;

grinding means disposed at the side of said passageway for grinding the end face of the coil spring fed by said carrier means through said passageway; and urging means for urging said clamping means to said clamping position, the urging action of said urging means being rendered effective at least during a period of time in which the end face of the coil spring is ground by said grinding means.

12. A grinding machine according to claim 11, wherein said conveying means includes an endless chain, and said base plates are secured in series to said endless chain.

13. A grinding machine according to claim 11, wherein said clamping means includes a swingable lever pivotally mounted on said each of said carrier means and a spring for biasing said swingable lever to said coil spring releasing original position.

14. A grinding machine according to claim 11, wherein said urging means includes an urging bar arranged along said passageway above the same and substantially in parallel therewith, one end of said urging bar extending up to the proximity of the coil spring feed-in position.

15. A grinding machine according to claim 14, wherein said clamping means includes a swingable lever pivotally mounted on each carrier means and an engagement roll rotatably pivoted by said swingable lever and engageable with said urging bar, said clamping means being maintained at said clamping position while said engagement roll is in engagement roll is in engagement with said urging bar.

16. A grinding machine according to claim 11, wherein said each of said carrier means further includes a post member mounted on the base plate and rearwardly of said receptacle members, and said clamping means includes a swingable lever pivotally mounted upon the upper end portion of said post member and a spring anchored between said post member and said swingable lever for biasing said swingable lever toward said coil spring releasing original position.

17. A grinding machine according to claim 11, wherein each of said carrier means further comprises a pair of guide rail members mounted to both edge portions of the underside of each base plate; and said machine frame comprises a plurality of guide rolls rotatably mounted thereon for slidably supporting said guide rail members, said guide rolls being arranged in two parallel lines along said passageway.

18. A grinding machine according to claim 17, which further comprises a fulcrum pin provided between a pair of said guide rail members and another adjacent pair of said guide rail members, to limit an interval between two adjacent carrier means and to prevent relative vertical movement between said two adjacent carrier means.

19. A grinding machine according to claim 11, wherein said urging means includes an urging bar arranged along said passageway above the same and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for the purpose of adjusting the vertical position of said intermediate member by its rotation.

20. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring, said clamping means including a swingable lever pivotally mounted on said each of said carrier means and a spring for biasing said swingable lever to said coil spring releasing original position;

grinding means disposed at the side of said passageway for grinding the end face of the coil spring fed by said carrier means through said passageway; and urging means for urging said clamping means to said clamping position, said urging means including an urging bar arranged along and above said passageway and substantially in parallel therewith, one end of said urging bar extending up to the proximity of said coil spring feed-in end position; and said clamping means including an engagement roll rotatably pivoted by said swingable lever and engageable with said urging bar, said clamping means being maintained at said clamping position while said engagement roll is in engagement with said urging bar;

the urging action of said urging means being rendered effective at least during a period of time in which the end face of the coil spring is ground by said grinding means.

21. A grinding machine according to claim 20, wherein each of said carrier means includes a base plate and receptacle means mounted on said base plate, said receptacle means having concave surfaces for engagement with a coil spring.

22. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame, each of said carrier means including:

a base plate;

receptacle means mounted on said base plate, said receptacle means having concave surfaces for engagement with a coil spring; and a pair of guide rail members mounted to both edge portions of the underside of each base plate;

said machine frame comprising a plurality of guide rolls rotatably mounted thereon for slideably supporting said guide rail members, said guide rolls being arranged in two parallel lines along said passageway;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring, said clamping means including a swingable lever pivotally mounted on said each of said carrier means and a spring for biasing said swingable lever to said coil spring releasing original position;

grinding means disposed at the side of said passageway for grinding the end face of the coil spring fed by said carrier means through said passageway; and urging means for urging said clamping means to said clamping position, the urging action of said urging means being rendered effective at least during a period of time in which the end face of the coil spring is ground by said grinding means.

23. A grinding machine according to claim 22, which further comprises a fulcrum pin provided between a pair of said guide rail members and another adjacent pair of said guide rail members, to limit an interval between two adjacent carrier means and to prevent relative vertical movement between said two adjacent carrier means.

24. A grinding machine according to claim 22, wherein said clamping means includes means for normally biasing same towards said coil spring releasing original position, and wherein said urging means urges said clamping means from said coil spring releasing original position to said clamping position.

25. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said carrier means by engagement therewith, and a coil spring releasing original position in which the clamping means is disengaged from the coil spring, said clamping means including a swingable lever pivotally mounted on said each of said carrier means and a spring for biasing said swingable lever to said coil spring releasing original position;

grinding means disposed at the side of said passageway for grinding the end face of the coil spring fed by said carrier means through said passageway; and urging means for urging said clamping means to said clamping position, said urging means including an urging bar arranged along and above said passageway and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for the purpose of adjusting the vertical position of said intermediate member by its rotation, the urging action of said urging means being rendered effective at least during a period of time in which the end face of the coil spring is ground by said grinding means.

26. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame, each of said carrier means including:

a base plate;

a plurality of receptacle members mounted on said base plate, each of said receptacle members having concave surfaces for engagement with a coil spring;

a post member mounted on said base plate and rearwardly of said receptacle members;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring, said clamping means including a swingable lever pivotally mounted upon the upper end portion of said post member and a spring anchored between said post member and said swingable lever for biasing said swingable lever toward said coil spring releasing original position;

grinding means disposed at the side of said passageway for grinding the end face of the coil spring fed by said carrier means through said passageway; and urging means for urging said clamping means to said clamping position, the urging action of said urging means being rendered effective at least during a period of time in which the end face of the coil spring is ground by said grinding means.

27. A grinding machine according to claim 26, wherein each of said carrier means further comprises a pair of guide rail members mounted to both edge portions of the underside of each base plate; and said machine frame comprises a plurality of guide rolls rotatably mounted thereon for slidably supporting said guide rail members, said guide rolls being arranged in two parallel lines along said passageway.

28. A grinding machine according to claim 27, which further comprises a fulcrum pin provided between a pair of said guide rail members and another adjacent pair of said guide rail members, to limit an interval between two adjacent carrier means and to prevent relative vertical movement between said two adjacent carrier means.

29. A grinding machine according to claim 26, wherein said urging means includes an urging bar arranged along said passageway above the same and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for the purpose of adjusting the vertical position of said intermediate member by its rotation.

30. A grinding machine for grinding the end face of a coil spring, comprising:

a machine frame having a substantially horizontally extending passageway therein;

a plurality of carrier means such for receiving a coil spring therein, and movable through said passageway of said machine frame in a state supporting the coil spring crosswise with respect to the longitudinal direction in which said passageway extends in said machine frame, each of said carrier means including:

a base plate;

receptacle means mounted on said base plate, said receptacle means having concave surfaces for engagement with a coil spring; and a pair of guide rail members mounted to both edge portions of the underside of each base plate;

said machine frame comprising a plurality of guide rolls rotatably mounted thereon for slidably supporting said guide rail members, said guide rolls being arranged in two parallel lines along said passageway;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring;

grinding means disposed at the side of said passageway for grinding the end face of the coil spring fed by said carrier means through said passageway; and urging means for urging said clamping means to said clamping position, the urging action of said urging means being rendered effective at least during a period of time in which the end face of the coil spring is ground by said grinding means.

31. A grinding machine according to claim 30 wherein said clamping means includes means for normally biasing same toward said coil spring releasing original position.

32. A grinding machine according to claim 31 wherein said urging means urges said clamping means from said coil spring releasing original position to said clamping position.

33. A grinding machine according to claim 32, wherein each of said guide rail members has forward and rearward end faces each of which is formed with an arcuate recess, and wherein said grinding machine further comprises a fulcrum pin engaged with the mutually opposite arcuate recesses of two adjacent guide rail members, said fulcrum pin limiting an interval between two adjacent carrier means and to prevent relative vertical movement between said two adjacent carrier means.

34. A grinding machine according to claim 30, which further comprises a fulcrum pin provided between a pair of said guide rail members and another adjacent pair of said guide rail members, to limit an interval between two adjacent carrier means and to prevent relative vertical movement between said two adjacent carrier means.

35. A grinding machine according to claim 30, wherein said urging means includes an urging bar arranged along said passageway above the same and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for the purpose of adjusting the vertical position of said intermediate member by its rotation.

36. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring;

grinding means disposed at the side of said passageway for grinding the end face of the coil spring fed by said carrier means through said passageway;

urging means for urging said clamping means to said clamping position, said urging means including an urging bar arranged along and above said passageway and substantially in parallel therewith, one end of said urging bar extending up to said proximity of the coil spring feed-in end position; and said clamping means including a swingable lever pivotally mounted on each carrier means and an engagement roll rotatably pivoted by said swingable lever and engageable with said urging bar, said clamping means being maintained at said clamping position while said engagement roll is in engagement with said urging bar;

the urging action of said urging means being rendered effective at least during a period of time in which the end face of the coil spring is ground by said grinding means.

37. A grinding machine according to claim 36 wherein said clamping means includes means for normally biasing same toward said coil spring releasing original position.

38. A grinding machine according to claim 37 wherein said urging means urges said clamping means from said coil spring releasing original position to said clamping position.

39. A grinding machine for grinding the end face of a coil spring, comprising:

a machine frame having a substantially horizontally extending passageway therein;

a plurality of carrier means each for receiving a coil spring therein, and movable through said passageway of said machine frame in a state supporting the coil spring crosswise with respect to the longitudinal direction in which said passageway extends in said machine frame;

conveying means for consecutively conveying said carrier means at prescribed intervals through said passageway from a coil spring feed-in end position at one end of said passageway to a coil spring feed-out end position at the other end of said passageway;

clamping means provided on each of said carrier means and swingable between a clamping position for clamping the coil spring received by said each carrier means by engagement therewith, and a coil spring releasing original position in which the clamping means is disengaged from the coil spring;

grinding means disposed at the side of said passageway for grinding the end face of the coil spring fed by said carrier means through said passageway; and urging means for urging said clamping means to said clamping position, said urging means including an urging bar arranged along and above said passageway and substantially in parallel therewith, a supporting member secured to said urging bar and having a threaded rod portion, an intermediate member having an opening for said threaded rod portion to be inserted therethrough, a compression coil spring wound around said threaded rod portion between said intermediate member and said supporting member, a nut member fitted over said threaded rod portion by screw engagement so as to adjust the relative position of said intermediate member to said supporting member and the biasing force of said compression coil spring, and a screw rod fitted into said intermediate member and supported by said machine frame for adjusting the vertical position of said intermediate member by its rotation, the urging action of said urging means being rendered effective at least during a period of time in which the end face of the coil spring is ground by said grinding means.

40. A grinding machine according to claim 39, wherein said clamping means includes a swingable lever pivotally mounted on each carrier means and an engagement roll rotatably pivoted by said swingable lever and engageable with said urging bar, said clamping means being maintained at said clamping position while said engagement roll is in engagement with said urging bar.

41. A grinding machine according to claim 39 wherein said clamping means includes means for normally biasing same toward said coil spring releasing original position.

42. A grinding machine according to claim 41 wherein said urging means urges said clamping means from said coil spring releasing original position to said clamping position.

* * * * *